United States Patent [19]

Link

[11] Patent Number: 4,820,066

[45] Date of Patent: Apr. 11, 1989

[54] METHOD AND DEVICE FOR COUPLING A CASSETTE SUPPORTED TYPEWHEEL TO A TYPEWHEEL POSITIONING SHAFT IN TYPEWRITERS OR SIMILAR MACHINES

[75] Inventor: Manfred Link, Nuremberg, Fed. Rep. of Germany

[73] Assignee: TA Triumph-Adler Aktiengesellschaft, Nuremberg, Fed. Rep. of Germany

[21] Appl. No.: 20,347

[22] Filed: Mar. 2, 1987

[30] Foreign Application Priority Data

Feb. 28, 1986 [DE] Fed. Rep. of Germany ..... 3606545

[51] Int. Cl.[4] ..... B41J 1/30

[52] U.S. Cl. ..... 400/144.2; 400/144.3

[58] Field of Search ..... 400/144.2, 144.3, 663, 400/175

[56] References Cited

U.S. PATENT DOCUMENTS

| | | | |
|---|---|---|---|
| 4,127,335 | 11/1981 | Bogert et al. . | |
| 4,264,220 | 4/1981 | Okcuoglu | 400/144.2 |
| 4,310,255 | 1/1982 | Asano et al. . | |
| 4,314,770 | 2/1982 | Harre | 400/144.2 |
| 4,363,559 | 12/1982 | Suzuki et al. | 400/144.2 |
| 4,389,129 | 6/1983 | Sugiura | 400/175 |
| 4,389,130 | 6/1983 | Giolitti | 400/175 |
| 4,408,909 | 10/1983 | Asano et al. | 400/175 |
| 4,428,694 | 1/1984 | Ragen | 400/175 |
| 4,475,827 | 10/1984 | Willemse et al. | 400/175 |
| 4,496,254 | 1/1985 | Lau et al. | 400/175 |
| 4,507,001 | 3/1985 | Babler | 400/144.2 |
| 4,576,493 | 3/1986 | Staniszewski | 400/175 |

FOREIGN PATENT DOCUMENTS

| | | |
|---|---|---|
| 0013346 | 9/1981 | European Pat. Off. . |
| 2937678 | 4/1980 | Fed. Rep. of Germany . |
| 3207205 | 9/1983 | Fed. Rep. of Germany . |
| 3211402 | 9/1983 | Fed. Rep. of Germany . |

*Primary Examiner*—Edgar S. Burr
*Assistant Examiner*—Huong Q. Pham
*Attorney, Agent, or Firm*—Browdy and Neimark

[57] ABSTRACT

A method for automatically coupling a typewheel rotatably mounted in a cassette to a typewheel positioning shaft. After the insertion of the typewheel supporting cassette into a typewriter or printer, a coupling sequence is initiated under the control of a microprocessor. During the coupling sequence the typewheel positioning motor is driven to turn a clutch part first in one and then in another direction by a certain angle causing coupling projections on the clutch part to engage corresponding coupling slots on the typewheel. During the coupling sequence, the typewheel is prevented from co-rotating unintentionally due to its moment of inertia and due to active frictional forces.

3 Claims, 1 Drawing Sheet

METHOD AND DEVICE FOR COUPLING A CASSETTE SUPPORTED TYPEWHEEL TO A TYPEWHEEL POSITIONING SHAFT IN TYPEWRITERS OR SIMILAR MACHINES

BACKGROUND OF THE INVENTION

1. Field of the Invention

This invention relates to a method and a device for coupling a cassette supported typewheel to a typewheel positioning shaft in electronically controlled typewriters or similar machines.

2. Description of Prior Art

Typewriters or printers have become known in which a cassette supported typewheel and a typewheel positioning shaft are coupled automatically after the cassette has been inserted into an appropriate seating device. For instance, the U.S. Pat. No. 4,127,335 shows such a device which, however, requires considerable mechanical sophistication. To equip a machine with this known device means a high machine price. The situation is similar for an arrangement according to DE-OS 29 37 678 which also necessitates unjustifiably high costs to be able to couple the typewheel to the typewheel positioning shaft. Other devices, e.g. according to DE-OS 32 11 402, show mechanisms in which the typewheel must be arrested prior to the actual coupling process. This also requires a corresponding mechanical sophistication. The cassette supported typewheel mounting scheme in European Pat. No. 13 346 also is disadvantageous in that the cassette mounted typewheel cannot be turned when the cassette is removed from the machine. This means that before the cassette with the typewheel is removed from the machine a routing program must be run to assure that the typewheel is in a predetermined, defined basic position in the cassette in order to be fixed unturnably in the cassette. When inserting the cassette into the machine, a motion cycle must be run which sees to it that the typewheel can be turned in the cassette.

All of these known devices have the disadvantage of not inconsiderable costs for mechanical parts, resulting in increased production and assembly costs. Also, in some, programs must be run which also have an unfavorable effect on costs or take time.

SUMMARY OF THE INVENTION

In accordance with the invention there is provided a method for automatically coupling a cassette mounted typewheel to a typewheel positioning shaft. During the coupling process the typewheel and a drive clutch part are so designed that the typewheel is not rotated by the drive clutch part until mating typewheel and clutch parts come into engagement. Rotation of the typewheel before engagement is prevented due to the moment of inertia of the typewheel and to frictional forces acting on the typewheel, but these require no additional mechanism.

An object of the invention is to provide a method which permits in an inexpensive manner and without necessary time loss, the mounting and automatic coupling of a cassette supported typewheel to its positioning shaft.

Other objects, features and advantages of the present invention will become better known to those skilled in the area from a reading of the following detailed description when taken in conjunction with the accompanying drawing wherein like reference numerals designate like or corresponding elements throughout the several views thereof and wherein:

DETAILED DESCRIPTION OF PREFERRED EMBODIMENT

Figure 1:
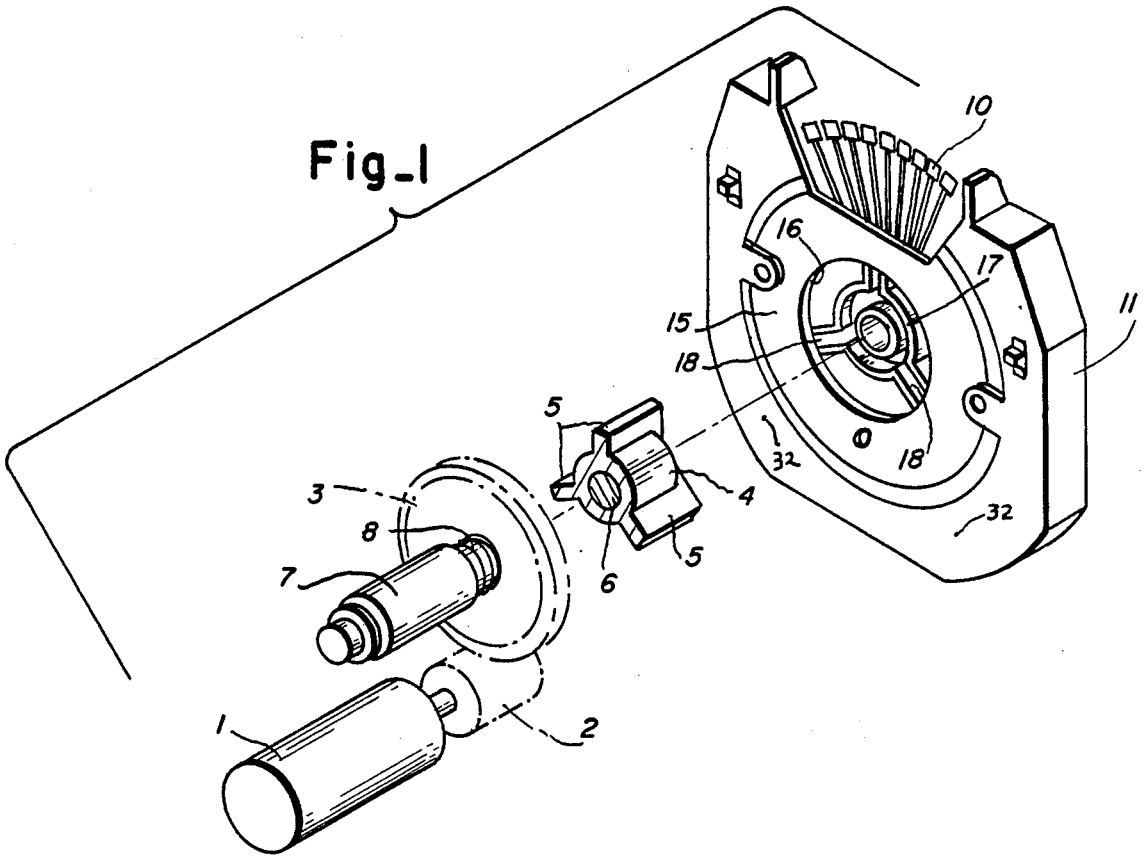
FIG. 1 is an exploded perspective view of a positioning motor drive clutch and a cassette supported typewheel which are to be coupled.
Figure 2:
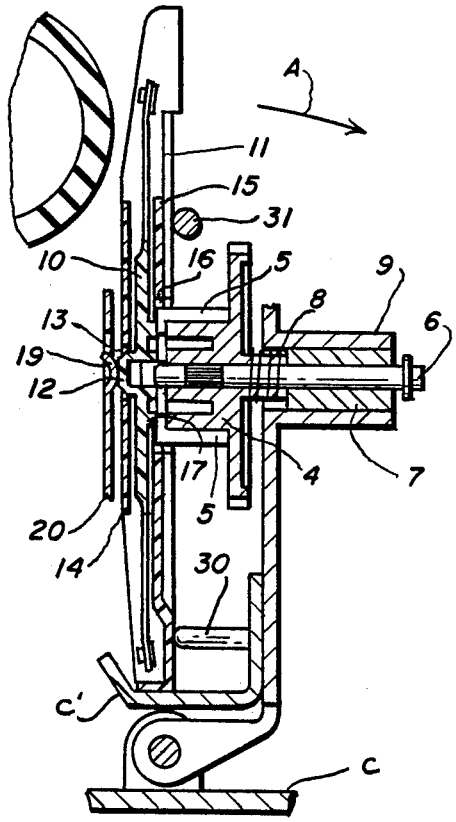
FIG. 2 is a cross sectional view of an inserted typewheel with the clutch part still to be rotated to a coupling position.

Referring now to the drawing there is shown in FIG. 1 a typewheel positioning motor 1 and its pinion 2 meshing with a gear 3 comprising a clutch part 4. As shown in FIGS. 1 and 2, three equi-angularly disposed coupling projections 5 extend radially outwardly from, axially beyond the hub of the clutch part in the direction of the cassette, and radially inwardly toward the axis of the hub. The gear 3 with the clutch part 4 is fixed on a shaft 6, as by being pressed thereon, and the shaft is rotatably mounted in a plain bearing sleeve 7. Mounted around shaft 6 and interposed between the bearing sleeve 7 and the gear 3 is a compression spring 8. It may be seen from FIG. 2 that the plain bearing sleeve 7 is located within a holder 9 which is pivotally mounted to a carriage part C which also supports the typewheel positioning motor 1 in a manner not detailed in the drawing.

The typewheel 10 is rotatably mounted in a cassette 11. For this purpose there is formed on the typewheel 10 a central axially extending projection 12 which penetrates a hole 13 in a wall 14 of the cassette. The other parallel cassette wall 15 also has a central, round hole 16 which is large enough in diameter to be penetrated by the clutch part 4 and the radial coupling projections 5 thereon. Formed on the side of the typewheel 10 in the area facing the hole 16 is a raised ring 17 from which spaced radial projections extend to define equi-angularly spaced radial coupling slots 18 corresponding in number to coupling projections 5.

As is apparent, to vertically remove or insert a typewheel carrying cassette 11, the clutch holder 9 must first be pivoted in arrow direction A thereby to decouple clutch projections 5 from typewheel slots 18, or opposite direction A to effect coupling, as will hereafter appear, of the clutch projections 5 with slots 18 in the typewheel hub.

When, as shown in FIG. 2, a cassette 11 is inserted in the typewriter or printer, it is seated on a fixed carriage part C'. In the seated position shown in FIG. 2, the central projection 12 on the typewheel 10 extending into hole 13 in cassette wall 14 is in contact with a bearing surface 19 of a carriage part and the cassette 11 is located between bearing surface 19 on one side and a horizontal bar 31 and spaced pins 30, on the other side, the latter extending horizontally from fixed carriage part C' for engagement with the wall 15 of the cassette 11 as at points 32 (FIG. 1). The cassette 11 is retained in this position during movement of the clutch parts 4 away from or toward the cassette 11.

After the insertion of a cassette 11, the pivotable carriage part or holder 9 must be moved opposite to arrow A. It is assumed here that the coupling slots 18 and the coupling projections 5 are not opposite each other as the typewheel 10 in an unmounted cassette 11 can rotate relative to its cassette 11. This misaligned position of the coupling projections 5 and slots 18 extending from ring 17 is shown in FIG. 2. The radially inwardly directed portions of the coupling projections 5 thus position themselves on the ring 17 of the typewheel 10. Since the typewheel 10 is in contact with the bearing surface 19, it cannot yield. But the clutch part 4 with its shaft 6 in the plain bearing sleeve 7 can yield, counter to the force of spring 8. This means that, with respect to FIG. 2, the clutch part 4 moves to the right. If the machine is then started, which may occur automatically, e.g. by closing cover switch, a coupling sequence controlled by a microcomputer is initiated. This coupling sequence consists of turning the positioning motor 1 and, hence, the clutch part 4, by e.g. 180° in one direction, and immediately thereafter in the other direction by the same angular distance. Due to the fact that only small areas of the coupling projections 5 are in contact with the ring 17 of the typewheel 10 there is only little friction between these parts. Due to the mass inertia of the typewheel 10 and the friction between the shaft projection 12 and the bearing surface 19 and due to the rotary velocity of the clutch part 4 on the other hand, it is achieved that the typewheel 10 remains at a standstill so that the coupling projections 5 engage the coupling slots 18 some time, i.e. at some angle between 0° and 180° without the need to arrest the typewheel specially. The engagement of the coupling projections 5 with the coupling slots 18 is accomplished by the force of the spring 8. Thus, coupling the typewheel 10 to the clutch part 4 is automatic. After the clutch and typewheel have been coupled, the typewheel can be brought to a basic position in an initializing sequence in a manner known to the art. Prior to removing a cassette 11 from the machine it is not necessary to bring the typewheel 10 into a defined basic position in which it is fixed in the cassette. Therefore, uncoupling from and coupling to the clutch part 4 can occur in any position of the typewheel in the cassette 11.

In modifications of the embodiment shown, the ring 17 may also have a crowned surface, for instance; the coupling projections 5 may be wedge shaped and the coupling slots 18 of corresponding design. Too, the transmission of the rotary motion from the motor 1 to the clutch part 4 need not be by means of a pinion 2 and gear 3 as a pulling means such as a toothed belt could also be used for this purpose.

The number of coupling slots 18 may be determined according to the size of the typewheel 10 and, hence, of the masses to be moved.

The invention claimed is:

1. A device for automatically coupling a typewheel to a rotary positioning motor of an electronically controlled typewriter or the like comprising:

a cassette in which the typewheel is rotatably mounted;

a rotary positioning shaft connected to the rotary positioning motor;

means to rotate said shaft in either of two directions to provide a searching movement;

a spring-biased clutch part connected to said rotary shaft, said clutch part adapted to adjoin a hub of the typewheel during the coupling process;

a raised ring comprising a plurality of coupling slots provided on the typewheel;

a plurality of coupling projections provided on said clutch part adapted to connect with said plurality of coupling slots;

spring means for biasing said clutch part towards said typewheel such that said plurality of coupling projections connect with said plurality of coupling slots during the searching movement in both directions of rotation, wherein upon rotation of said clutch part, said typewheel remains stationary responsive to inertial and frictional forces until the coupling process is completed.

2. The device according to claim 1, wherein said plurality of coupling slots and said plurality of coupling projections comprise three slots and three projections, respectively.

3. The device according to claim 1, further comprising a bearing sleeve for rotatably mounting said positioning shaft, said spring means being interposed between said clutch part and said bearing sleeve.

* * * * *